US009859661B2

(12) United States Patent
Park et al.

(10) Patent No.: US 9,859,661 B2
(45) Date of Patent: Jan. 2, 2018

(54) CONNECTOR OF AN ELECTRONIC DEVICE

(71) Applicant: Samsung Electronics Co., Ltd., Suwon-si, Gyeonggi-do (KR)

(72) Inventors: Chan Gi Park, Suwon-si (KR); Eun Seok Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/141,235

(22) Filed: Apr. 28, 2016

(65) Prior Publication Data

US 2016/0322759 A1 Nov. 3, 2016

(30) Foreign Application Priority Data

Apr. 29, 2015 (KR) ..... 10-2015-0060826

(51) Int. Cl.

| | |
|---|---|
| ***H01R 13/648*** | (2006.01) |
| ***H01R 13/6585*** | (2011.01) |
| ***H01R 13/6595*** | (2011.01) |
| ***H01R 13/6596*** | (2011.01) |
| ***H01R 24/60*** | (2011.01) |
| ***H01R 13/6594*** | (2011.01) |
| *H01R 12/72* | (2011.01) |

(52) U.S. Cl.
CPC ..... *H01R 13/6585* (2013.01); *H01R 13/6594* (2013.01); *H01R 13/6595* (2013.01); *H01R 13/6596* (2013.01); *H01R 24/60* (2013.01); *H01R 12/722* (2013.01)

(58) Field of Classification Search
CPC ..... H01R 13/6587
USPC ..... 439/660, 607.11, 607.08, 607.09, 607.1
See application file for complete search history.

(56) References Cited

U.S. PATENT DOCUMENTS

| | | | | |
|---|---|---|---|---|
| 6,554,648 | B2 | 4/2003 | Shi et al. | |
| 7,604,512 | B1 | 10/2009 | Chen | |
| 8,109,795 | B2 | 2/2012 | Lin et al. | |
| 8,308,515 | B2 | 11/2012 | Chang | |
| 8,747,165 | B2 * | 6/2014 | Kim | H01R 24/60 439/607.53 |
| 8,968,031 | B2 * | 3/2015 | Simmel | H01R 13/659 439/108 |

(Continued)

FOREIGN PATENT DOCUMENTS

| | | |
|---|---|---|
| CN | 204179373 U | 2/2015 |
| CN | 204216324 U | 3/2015 |

(Continued)

OTHER PUBLICATIONS

"Universal Serial Bus Type-C Cable and Connector Specification", Release 1.0, Aug. 11, 2014, pp. 1-171.

*Primary Examiner* — Phuong Dinh
(74) *Attorney, Agent, or Firm* — Jefferson IP Law, LLP

(57) ABSTRACT

A connector mounted on a printed circuit board (PCB) is provided. The connector includes a mid-plate electrically connected to a ground terminal of the PCB and including a metallic material, a plurality of upper terminals situated on the mid-plate, a plurality of lower terminals situated under the mid-plate, a first insulation member situated on the mid-plate while supporting the upper terminals, a second insulation member situated under the mid-plate while supporting the lower terminals, and a pad electrically connected to the mid-plate and shielding an electromagnetic wave.

15 Claims, 13 Drawing Sheets

(56) References Cited

U.S. PATENT DOCUMENTS

| | | | | |
|---|---|---|---|---|
| 9,306,336 | B2 * | 4/2016 | Chang | H01R 13/6471 |
| 9,450,337 | B2 * | 9/2016 | Kao | H01R 13/6461 |
| 2001/0053630 | A1 | 12/2001 | Shi et al. | |
| 2010/0267261 | A1 | 10/2010 | Lin et al. | |
| 2012/0003852 | A1 | 1/2012 | Chang | |
| 2015/0044886 | A1 | 2/2015 | Little et al. | |
| 2015/0311636 | A1 * | 10/2015 | Chang | H01R 13/6471 439/607.28 |
| 2016/0049756 | A1 | 2/2016 | Yen et al. | |
| 2016/0064871 | A1 | 3/2016 | Leng et al. | |
| 2016/0104976 | A1 | 4/2016 | Yu et al. | |
| 2016/0233631 | A1 | 8/2016 | Yen et al. | |
| 2017/0279234 | A1 | 9/2017 | Tsai | |

FOREIGN PATENT DOCUMENTS

| | | | |
|---|---|---|---|
| CN | 204243301 | U | 4/2015 |
| KR | 10-2009-0072597 | A | 7/2009 |
| KR | 10-2012-0110068 | A | 10/2012 |
| TW | M493184 | U | 1/2015 |
| WO | 2016/041522 | A1 | 3/2016 |

* cited by examiner

CONNECTOR OF AN ELECTRONIC DEVICE

CROSS-REFERENCE TO RELATED APPLICATION(S)

This application claims the benefit under 35 U.S.C. §119 (a) of a Korean patent application filed on Apr. 29, 2015 in the Korean Intellectual Property Office and assigned Serial number 10-2015-0060826, the entire disclosure of which is hereby incorporated by reference.

TECHNICAL FIELD

The present disclosure relates to a connector of an electronic device. More particularly, the present disclosure relates to a connector that reduces the size of an electromagnetic compatibility (EMC) pad by changing a ground connection structure of the EMC pad in the connector, resulting in reduction of the entire length of the connector.

BACKGROUND

A connector is embedded in various mobile devices, such as a smartphone and a tablet personal computer (PC), to receive electric power or signals from the outside or transmit signals to the outside. A corresponding plug may be coupled to the connector such that the mobile devices may receive electric power from the outside through the connector and transmit and receive signals to and from another device.

As the mobile devices have become miniaturized and the sizes of the connectors have become small, the technology of shielding electromagnetic waves and the ground processing technology have become an important issue recently. More particularly, in a universal serial bus (USB) type-C receptacle, an electromagnetic compatibility (EMC) pad for shielding electromagnetic waves is connected to the shell outside the receptacle and is soldered to the ground terminal of the printed circuit board (PCB). Accordingly, the size of the EMC pad increases, and the length of the connector also increases.

Therefore, a need exists for a connector that reduces the size of an EMC pad by changing a ground connection structure of the EMC pad in the connector, resulting in reduction of the entire length of the connector.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a connector that reduces the size of an EMC pad by changing a ground connection structure of the EMC pad in the connector, resulting in reduction of the entire length of the connector.

In accordance with an aspect of the present disclosure, a connector mounted on a printed circuit board (PCB) is provided. The connector includes a mid-plate electrically connected to a ground terminal of the PCB and including a metallic material, a plurality of upper terminals situated on the mid-plate, a plurality of lower terminals situated under the mid-plate, a first insulation member situated on the mid-plate while supporting the plurality of upper terminals, a second insulation member situated under the mid-plate while supporting the plurality of lower terminals, and a pad electrically connected to the mid-plate and shielding an electromagnetic wave.

In accordance with another aspect of the present disclosure, a connector mounted on a PCB is provided. The connector includes a plurality of terminals, an insulation member that supports the plurality of terminals, a mid-plate of a conductive material situated in the interior of the insulation member, a part of which is exposed to the outside of a side surface of the insulation member and is electrically connected to a ground terminal of the PCB, and a conductive pad situated on the plurality of terminals to shield an electromagnetic wave, wherein the conductive pad is electrically connected to the mid-plate.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
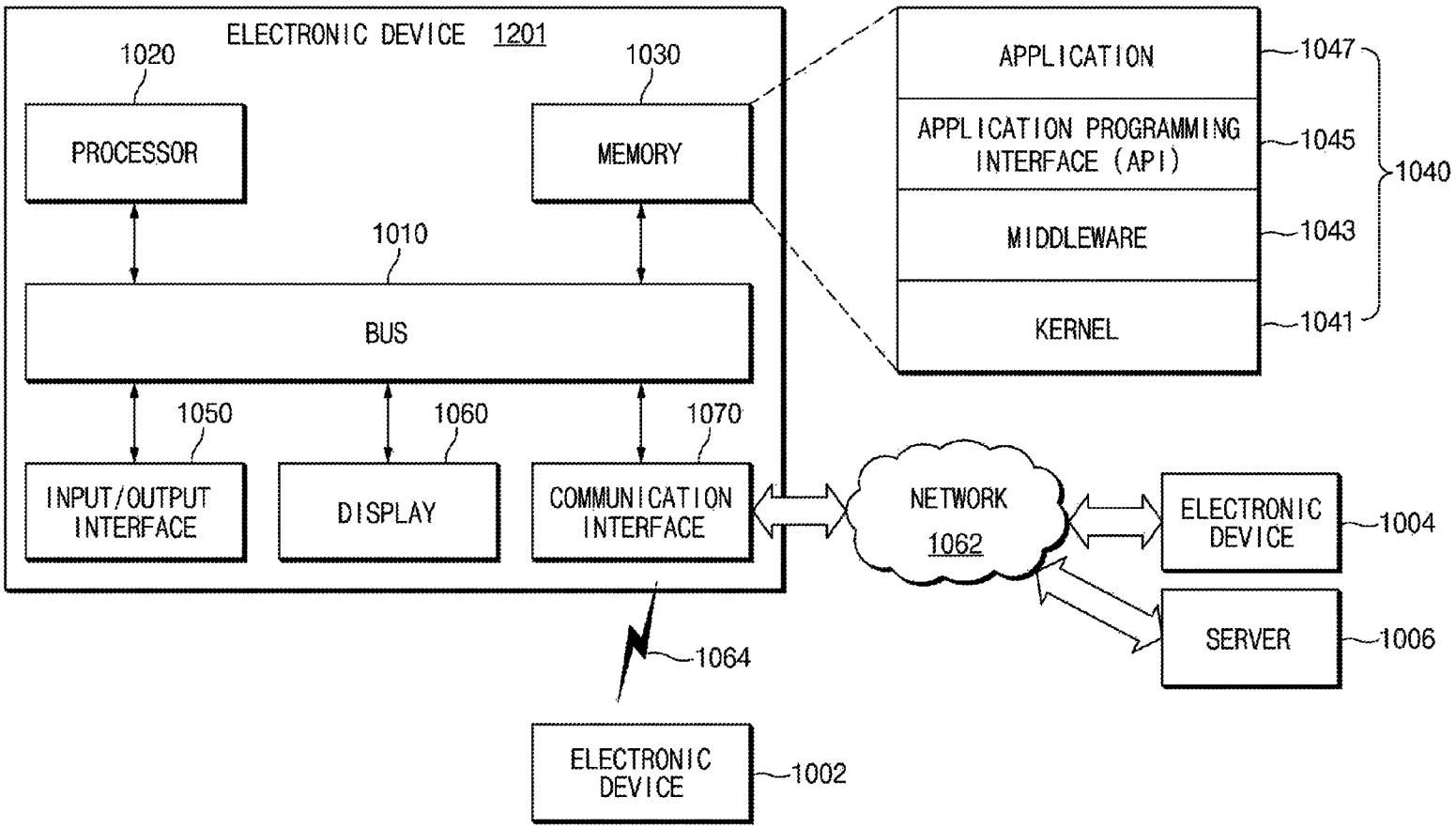
FIG. 1 illustrates a network environment of an electronic device including a connector according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

In an embodiment of the disclosure disclosed herein, the expressions "have", "may have", "include" and "comprise", or "may include" and "may comprise" used herein indicate existence of corresponding features (for example, elements, such as numeric values, functions, operations, or components) but do not exclude presence of additional features.

In an embodiment of the disclosure disclosed herein, the expressions "A or B", "at least one of A or/and B", or "one or more of A or/and B", and the like, used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like, used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), the element can be directly coupled with/to or connected to the other element or an intervening element (for example, a third element) may be present. In contrast, when an element (for example, the first element) is referred to as being "directly coupled with/to" or "directly connected to" another element (for example, the second element), it should be understood that there is no intervening element (for example, the third element).

According to the situation, the expression "configured to" used herein may be used as, for example, the expression "suitable for", "having the capacity to", "designed to", "adapted to", "made to", or "capable of". The term "configured to (or set to)" does not mean only "specifically designed to" in hardware. Instead, the expression "a device configured to" may mean that the device is "capable of" operating together with another device or other components. Central processing unit (CPU), for example, a "processor configured to (or set to) perform A, B, and C" may describe a dedicated processor (for example, an embedded processor) for performing a corresponding operation or a generic-purpose processor (for example, a CPU or an application processor (AP)) which may perform corresponding operations by executing one or more software programs which are stored in a memory device.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

An electronic device, according to various embodiments of the present disclosure, may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), a moving picture experts group phase 1 or phase 2 (MPEG-1 or MPEG-2) audio layer 3 (MP3) players, mobile medical devices, cameras, wearable devices, and the like. According to various embodiments of the present disclosure, the wearable devices may include accessories (for example, watches, rings, bracelets, ankle bracelets, glasses, contact lenses, or head-mounted devices (HMDs)), cloth-integrated types (for example, electronic clothes), body-attached types (for example, skin pads or tattoos), or implantable types (for example, implantable circuits).

In various embodiments of the present disclosure, the electronic device may be one of home appliances. The home appliances may include, for example, at least one of a digital versatile disc (DVD) player, an audio player, a refrigerator, an air conditioner, a cleaner, an oven, a microwave oven, a washing machine, an air cleaner, a set-top box, a home automation control panel, a security control panel, a television (TV) box (for example, Samsung HomeSync™, Apple TV™, or Google TV™), a game console (for example, Xbox™ or PlayStation™), an electronic dictionary, an electronic key, a camcorder, an electronic panel, and the like.

In an embodiment of the present disclosure, the electronic device may include at least one of various medical devices (for example, various portable medical measurement devices (i.e., a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (for example, a navigation device for vessels and a gyro compass), avionics, a security device, a vehicular head unit, an industrial or home robot, an automatic teller's machine (ATM) of a financial company, a point of sales (POS) of a store, or an internet of things (for example, a bulb, various sensors, an electricity or gas meter, a sprinkler device, a fire alarm device, a thermostat, an electric pole, a toaster, a sporting apparatus, a hot water tank, a heater, a boiler, and the like).

According to various embodiments of the present disclosure, the electronic device may include at least one of a furniture or a part of a building/structure, an electronic board, an electronic signature receiving device, a projector, or various measurement devices (for example, a water service, electricity, gas, or electric wave measuring device). In various embodiments of the present disclosure, the electronic device may be one or a combination of the aforementioned devices. The electronic device according to some embodiments of the present disclosure may be a flexible electronic device. Further, the electronic device, according to an embodiment of the present disclosure, is not limited to the aforementioned devices, but may include new electronic devices produced due to the development of technologies.

Hereinafter, an electronic device including a connector, according to various embodiments, will be described with reference to the accompanying drawings. The term "user" used herein may refer to a person who uses an electronic device or may refer to a device (for example, an artificially intelligent electronic device) that uses an electronic device.

FIG. 1 illustrates a network environment of an electronic device including a connector according to various embodiments of the present disclosure.

Referring to FIG. 1, an electronic device 1201 may include a bus 1010, a processor 1020, a memory 1030, an input/output interface 1050, a display 1060, and a communication interface 1070. In various embodiments of the present disclosure, the electronic device 1201 may exclude at least one of the components or may additionally include another component.

The bus 1010 may include, for example, a circuit that connects the components 1020 to 1070 and transfers communications (for example, control messages and/or data) between the components.

The processor 1020 may include one or more of a CPU, an AP, or a communications processor (CP). The processor 1020, for example, may execute operations or data processing related to the control and/or communication of at least one other component of the electronic device 1201.

The memory 1030 may include volatile and/or nonvolatile memories. The memory 1030, for example, may store commands or data related to at least one other component of the electronic device 1201. According to an embodiment of the present disclosure, the memory 1030 may store software and/or a program 1040. The program 1040, for example, may include a kernel 1041, middleware 1043, an application programming interface (API) 1045, and/or an application program (or an application) 1047. At least some of the kernel 1041, the middleware 1043, or the API 1045 may be referred to as an operating system (OS).

The kernel 1041, for example, may control or manage system resources (for example, the bus 1010, the processor 1020, and the memory 1030) that are used to execute operations or functions implemented in the other programs (for example, the middleware 1043, the API 1045, or the applications 1047). The kernel 1041 may provide an interface through which the middleware 1043, the API 1045, or the applications 1047 access individual components of the electronic device 1201 to control or manage the system resources.

The middleware 1043, for example, may function as an intermediary that allows the API 1045 or the applications 1047 to communicate with the kernel 1041 to exchange data.

The middleware 1043 may process one or more work requests received from the application programs 1047, according to their priorities. For example, the middleware 1043 may give a priority, by which a system resource (for example, the bus 1010, the processor 1020, or the memory 1030) of the electronic device 1201 may be used, to at least one of the application programs 1047. For example, the middleware 1043 may perform scheduling or load balancing for the one or more work requests by processing the one or more work requests according to the priority given to the at least one of the application programs 1047.

The API 1045 is an interface used, by the application 1047, to control a function provided by the kernel 1041 or the middleware 1043, and may include, for example, at least one interface or function (for example, an instruction), for example, for file control, window control, image processing, and text control.

The input/output interface 1050, for example, may function as an interface that may transfer commands or data that are input from the user or another external device to another component(s) of the electronic device 1201. The input/output interface 1050 may output commands or data received from another component(s) of the electronic device to the user or anther external device.

The display 1060, for example, may include a liquid crystal display (LCD), a light emitting diode (LED) display, an organic LED (OLED) display, a microelectromechanical system (MEMS) display, or an electronic paper display. The display 1060, for example, may display various contents (for example, a text, an image, a video, an icon, and a symbol) to the user. The display 1060 may include a touch screen and receive, for example, a touch, a gesture, a proximity, or a hovering input using an electronic pen or the user's body part.

The communication interface 1070, for example, may set a communication between the electronic device 1201 and an external device (for example, a first external electronic device 1002, a second external electronic device 1004, or a server 1006). For example, the communication interface 1070 may be connected to a network 1062 through a wireless communication or a wired communication to communicate with the external device (for example, the second external electronic device 1004 or the server 1006).

The wireless communication is, for example, a cellular communication protocol, and, for example, may use at least one of long-term evolution (LTE), LTE-advanced (ATE-A), code division multiple access (CDMA), wideband CDMA (WCDMA), a universal mobile telecommunications system (UMTS), wireless broadband (WiBro), or a global system for mobile communications (GSM). Furthermore, the wireless communication, for example, may include a short range communication 1064. The short range communication 1064, for example, may include at least one of Wi-Fi, Bluetooth, a near field communication (NFC), or a global navigation satellite system (GNSS). The GNSS may include at least one of, for example, a global positioning system (GPS), a global navigation satellite system (GLONASS), a BeiDou navigation satellite system (hereinafter referred to as "BeiDou"), or the European global satellite-based navigation system (Galileo), according to an in-use area or a bandwidth. Hereinafter, in the present disclosure, the "GPS" may be interchangeably used with the "GNSS". The wired communication may include at least one of, for example, a universal serial bus (USB), a high definition multimedia interface (HDMI), recommended standard-232 (RS-232), and a plain old telephone service (POTS). The network 1062 may include at least one of communication networks, for example, a computer network (for example, a local area network (LAN) or a wide-area network (WAN)), the Internet, or a telephone network.

The first external electronic device 1002 and the second external electronic device 1004 may be the same or different type devices from the electronic device 1201. According to an embodiment of the present disclosure, the server 1006 may include a group of one or more servers. According to various embodiments of the present disclosure, all or some of the operations executed by the electronic device 1201 may be executed by another or a plurality of electronic devices (for example, the first external electronic device 1002 and the second external electronic device 1004) or the server 1006. According to an embodiment of the present disclosure, when the electronic device 1201 should execute some functions or services automatically or upon request, the electronic device 1201 may request at least some functions associated with the functions or services from another device (for example, the first external electronic device 1002 and the second external electronic device 1004 or the server 1006), instead of or in addition to directly executing the functions or services. The other electronic device (for example, the first external electronic device 1002 or the second external electronic device 1004 or the server 1006) may execute a requested function or an additional function, and may transfer the result to the electronic device 1201. The electronic device 1201 may process the received result directly or additionally, and may provide a requested function or service. To this end, for example, the cloud computing, distributed computing, or client-server computing technologies may be used.

Figure 2:
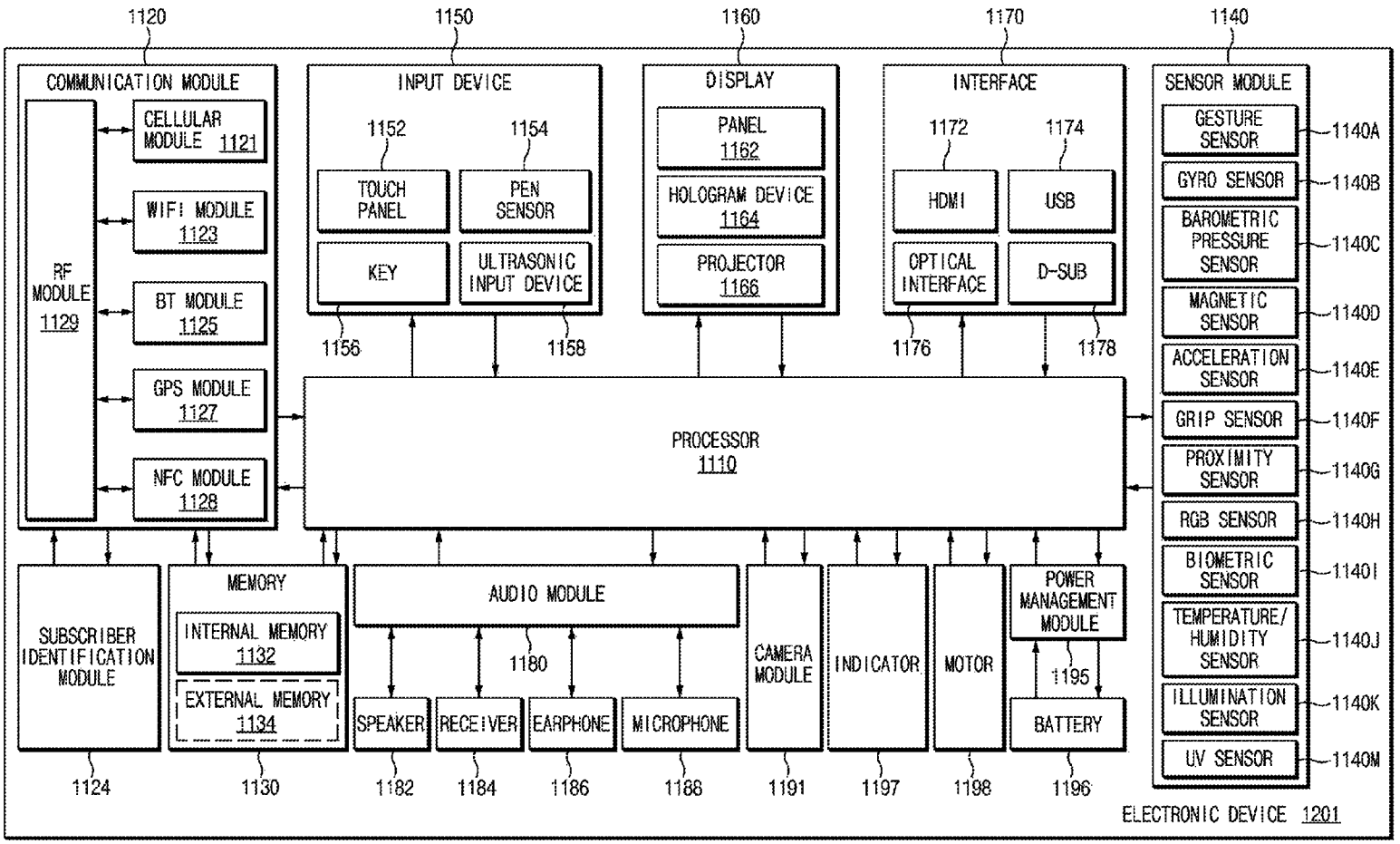
FIG. 2 is a block diagram of an electronic device including a connector according to an embodiment of the present disclosure.

FIG. 2 is a block diagram of an electronic device including a connector according to various embodiments of the present disclosure. The electronic device may include, for example, the entirety or a part of the electronic device 1201 illustrated in FIG. 1.

Referring to FIG. 2, the electronic device 1201 may include at least one processor (for example, an AP) 1110, a communication module 1120, a subscriber identification module 1124, a memory 1130, a sensor module 1140, an input device 1150, a display 1160, an interface 1170, an audio module 1180, a camera module 1191, a power management module 1195, a battery 1196, an indicator 1197, or a motor 1198.

The processor 1110 may control a plurality of hardware or software components connected to the processor 1110 by driving an OS or an application program and perform a variety of data processing and calculations. The processor 1110 may be implemented by, for example, a system on chip (SoC). According to an embodiment of the present disclosure, the processor 1110 may further include a graphics processing unit (GPU) and/or an image signal processor. The processor 1110 may include at least some (for example, a cellular module 1121) of the components illustrated in FIG. 2. The processor 1110 may load instructions or data, received from at least one other component (for example, a non-volatile memory), in a volatile memory to process the loaded instructions or data, and may store various types of data in a non-volatile memory.

The communication module 1120 may have the same or similar structure to the communication interface 1070 of FIG. 1. The communication module 1120 may include, for example, the cellular module 1121, a Wi-Fi module 1123, a Bluetooth module 1125, a GNSS module 1127 (for example, a GPS module, a GLONASS module, a BeiDou module, or a Galileo module), an NFC module 1128, and a radio frequency (RF) module 1129.

The cellular module 1121 may provide a voice call, a video call, a text message service, or an Internet service through, for example, a communication network. According to an embodiment of the present disclosure, the cellular module 1121 may distinguish and authenticate electronic devices 1201 within a communication network using a subscriber identification module (for example, a subscriber identification module (SIM) card 1124). According to an embodiment of the present disclosure, the cellular module 1121 may perform at least some of the functions which may be provided by the processor 1110. According to an embodiment of the present disclosure, the cellular module 1121 may include a CP.

Each of the Wi-Fi module 1123, the Bluetooth module 1125, the GNSS module 1127, and the NFC module 1128 may include a processor for processing data transmitted/received, for example, through the corresponding module. According to various embodiments of the present disclosure, at least some (two or more) of the cellular module 1121, the Wi-Fi module 1123, the Bluetooth module 1125, the GNSS module 1127, and the NFC module 1128 may be included in one integrated chip (IC) or IC package.

The RF module 1129 may transmit/receive, for example, a communication signal (for example, an RF signal). The RF module 1129 may include, for example, a transceiver, a power amp module (PAM), a frequency filter, a low noise amplifier (LNA), or an antenna. According to an embodiment of the present disclosure, at least one of the cellular module 1121, the Wi-Fi module 1123, the Bluetooth module 1125, the GNSS module 1127, or the NFC module 1128 may transmit and receive an RF signal through a separate RF module.

The SIM card 1124 may include, for example, a card including a SIM and/or an embedded SIM, and may further include unique identification information (for example, an integrated circuit card identifier (ICCID)) or subscriber information (for example, international mobile subscriber identity (IMSI)).

The memory 1130 (for example, the memory 1030) may include, for example, an internal memory 1132 or an external memory 1134. The internal memory 1132 may include at least one of, for example, a volatile memory (for example, a dynamic random access memory (DRAM), a static RAM (SRAM), a synchronous DRAM (SDRAM), and the like), a non-volatile memory (for example, a one time programmable read only memory (OTPROM), a programmable ROM (PROM), an erasable and programmable ROM (EPROM), an electrically erasable and programmable ROM (EEPROM), a flash memory (for example, a NAND flash memory or a NOR flash memory), a hard driver, or a solid state drive (SSD).

The external memory 1134 may further include a flash drive, for example, a compact flash (CF), a secure digital (SD), a micro-SD, a mini-SD, an extreme digital (xD), a multimedia card (MMC), a memory stick, and the like. The external memory 1134 may be functionally and/or physically connected to the electronic device 1201 through various interfaces.

The sensor module 1140 may measure, for example, a physical quantity or detect an operation state of the electronic device 1201, and may convert the measured or detected information to an electrical signal. The sensor module 1140 may include, for example, at least one of a gesture sensor 1140A, a gyro sensor 1140B, an atmospheric pressure sensor 1140C, a magnetic sensor 1140D, an acceleration sensor 1140E, a grip sensor 1140F, a proximity sensor 1140G, a color sensor 1140H (for example, red, green, and blue (RGB) sensor), a biometric sensor 1140I, a temperature/humidity sensor 1140J, an illumination sensor 1140K, and an ultraviolet (UV) sensor 1140M. Additionally or alternatively, the sensor module 1140 may include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1140 may further include a control circuit for controlling one or more sensors included therein. In various embodiments of the present disclosure, the electronic device 1201 may further include a processor configured to control the sensor module 1140 as a part of or separately from the processor 1110, and may control the sensor module 1140 while the processor 1110 is in a sleep state.

The input device 1150 may include, for example, a touch panel 1152, a (digital) pen sensor 1154, a key 1156, or an ultrasonic input device 1158. The touch panel 1152 may use at least one of, for example, a capacitive type, a resistive type, an infrared type, and an ultrasonic type. The touch panel 1152 may further include a control circuit. The touch panel 1152 may further include a tactile layer, and provide a tactile reaction to a user.

The (digital) pen sensor 1154 may include, for example, a recognition sheet which is a part of the touch panel or a separate recognition sheet. The key 1156 may include, for example, a physical button, an optical key, or a keypad. The ultrasonic input device 1158 may detect ultrasonic waves generated by an input tool through a microphone (for example, a microphone 1188) and may identify data corresponding to the detected ultrasonic waves.

The display 1160 (for example, the display 1060) may include a panel 1162, a hologram device 1164, or a projector 1166. The panel 1162 may include a component equal or similar to the display 1060 of FIG. 1. The panel 1162 may be implemented to be, for example, flexible, transparent, or wearable. The panel 1162 may be formed as a single module together with the touch panel 1152. The hologram device 1164 may show a three dimensional image in the air using an interference of light. The projector 1166 may display an image by projecting light onto a screen. The screen may be located, for example, in the interior of or on the exterior of the electronic device 1201. According to an embodiment of the present disclosure, the display 1160 may further include a control circuit for controlling the panel 1162, the hologram device 1164, or the projector 1166.

The interface 1170 may include, for example, an HDMI 1172, a USB 1174, an optical interface 1176, or a D-subminiature (D-sub) 1178. The interface 1170 may be included in, for example, the communication interface 1070 illustrated in FIG. 1. Additionally or alternatively, the interface 1170 may include, for example, a mobile high-definition link (MHL) interface, an SD card/MMC interface, or an infrared data association (IrDA) standard interface.

The audio module 1180 may bilaterally convert, for example, a sound and an electrical signal. At least some elements of the audio module 1180 may be included in, for example, the input/output interface 1045 illustrated in FIG. 1. The audio module 1180 may process sound information input or output through, for example, a speaker 1182, a receiver 1184, earphones 1186, the microphone 1188, and the like.

The camera module 1191 is, for example, a device which may photograph a still image and a dynamic image. According to an embodiment of the present disclosure, the camera module 1191 may include one or more image sensors (for example, a front sensor or a back sensor), a lens, an image signal processor (ISP) or a flash (for example, an LED or xenon lamp).

The power management module 1195 may manage, for example, power of the electronic device 1201. According to an embodiment of the present disclosure, the power management module 1195 may include a power management integrated circuit (PMIC), a charger IC, or a battery or fuel gauge. The PMIC may have a wired and/or wireless charging scheme. Examples of the wireless charging method may include, for example, a magnetic resonance method, a magnetic induction method, an electromagnetic wave method, and the like. Additional circuits, such as a coil loop, a resonance circuit, a rectifier, and the like, for wireless charging may be further included. The battery gauge may measure, for example, a residual quantity of the battery 1196, a voltage, a current, or a temperature while charging. The battery 1196 may include, for example, a rechargeable battery and/or a solar battery.

The indicator 1197 may indicate particular status of the electronic device 1201 or a part thereof (for example, the processor 1110), for example, a booting status, a message status, a charging status, and the like. The motor 1198 may convert an electrical signal into mechanical vibrations, and may generate a vibration or haptic effect. Although not illustrated, the electronic device 1201 may include a processing device (for example, a GPU) for supporting mobile TV. The processing unit for supporting mobile TV may process, for example, media data pursuant to a certain standard of digital multimedia broadcasting (DMB), digital video broadcasting (DVB), or media flow (mediaFlo™).

Each of the elements described in the specification may include one or more components, and the terms of the elements may be changed according to the type of the electronic device. In various embodiments of the present disclosure, the electronic device may include at least one of the elements described in the specification, and some elements may be omitted or additional elements may be further included. Some of the elements of the electronic device according to various embodiments may be coupled to form one entity, and may perform the same functions of the corresponding elements before they are coupled.

Figure 3:
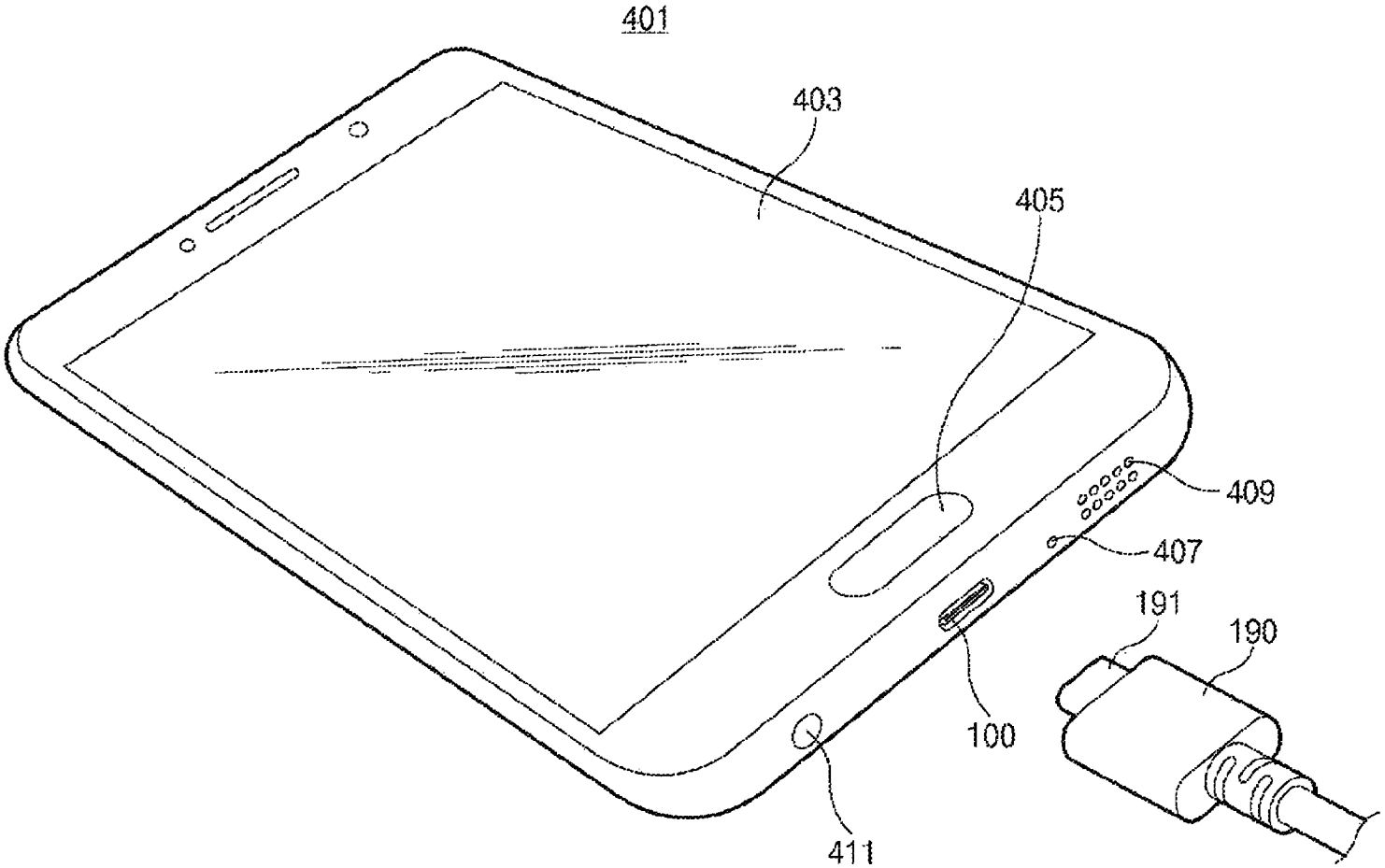
FIG. 3 illustrates an external appearance of an electronic device including a connector according to an embodiment of the present disclosure.

FIG. 3 illustrates an external appearance of an electronic device including a connector according to an embodiment of the present disclosure.

Referring to FIG. 3, an electronic device 401 may include a display panel 403, a key 405, an earphone jack 411, a connector 100, a microphone 407, a speaker 409, and a plug 190 and a shell 191. The connector 100 according to various embodiments of the present disclosure may be situated at a lower end of the electronic device 401. A plug 190 corresponding to the connector 100 may be inserted into the connector 100. When the plug 190 is inserted into the connector 100, the shell 191 of the plug 190 may have a ground potential while making contact with the shell 107 (see FIG. 4) of the connector 100.

The electronic device 401 may receive an electrical signal and electric power from the outside through the connector 100. For example, the electronic device 401 may receive an electrical signal that satisfies a USB interface standard. The electrical signal may include a high frequency signal, and noise generated due to the high frequency signal may influence the communication performance of the electronic device 401. The connector 100 may include a shell 107 (see FIG. 4) having a ground potential to restrain the noise. An antenna (not illustrated) may be situated around the connector 100, and a communication signal generated when the electronic device 401 performs a communication by using the antenna may influence an electrical signal that passes through the connector 100. The shell 107 of the connector 100 may reduce the influence of the communication signal.

Furthermore, the electronic device 401 may receive electric power through the connector 100 and may charge the battery 1196 (see FIG. 2) of the electronic device 401.

An earphone plug may be inserted into the earphone jack 411 and an audio signal of the electronic device 401 may be transferred through the earphone plug. The microphone 407 may convert a voice input to the electronic device 401 into an electrical signal. The speaker 409 may output various audio signals of the electronic device 401.

Figure 4:
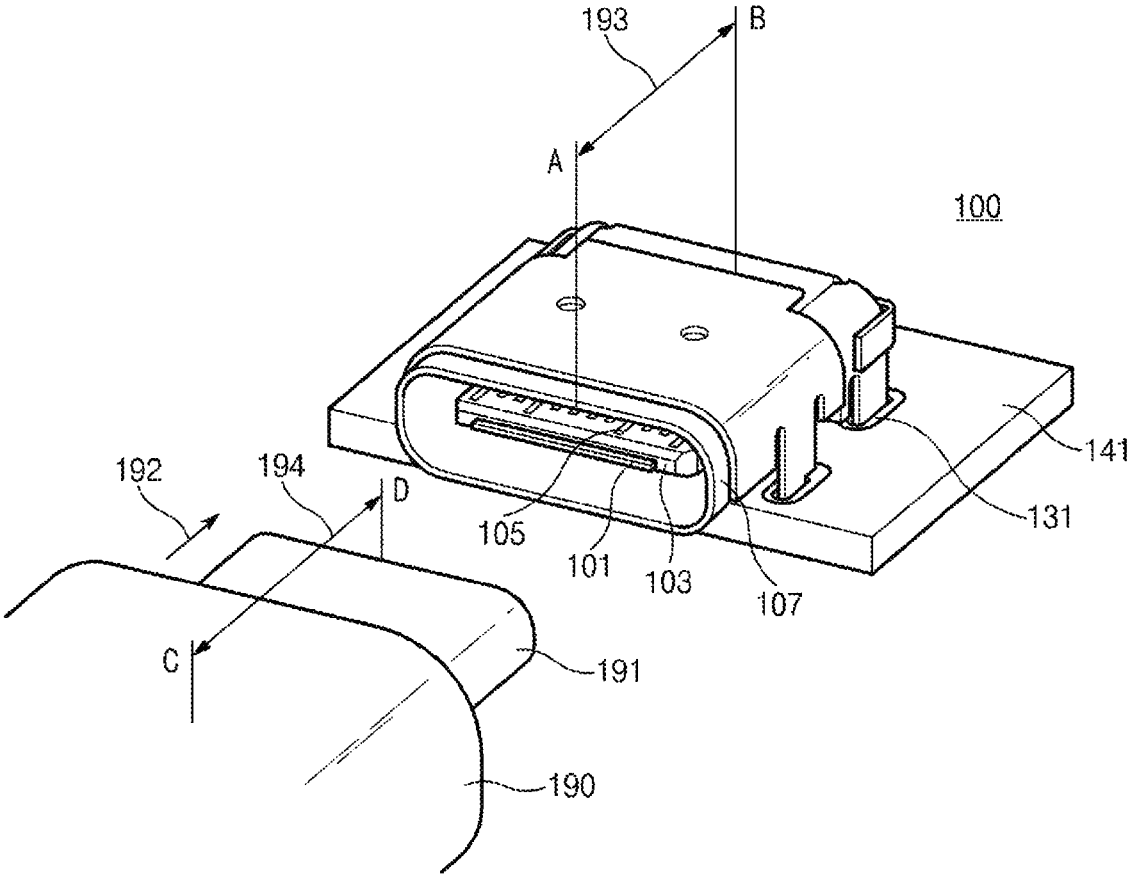
FIG. 4 illustrates a connector and a plug that may be coupled to the connector according to an embodiment of the present disclosure.

FIG. 4 illustrates a connector and a plug that may be coupled to the connector according to an embodiment of the present disclosure.

Referring to FIG. 4, the connector 100 may include a mid-plate 101, an insulation member 103, a plurality of terminals 105, and the shell 107. The connector is mounted on a printed circuit board (PCB) 141 and may be fixed through soldering. The connector, according to an embodiment of the present disclosure, may be classified into a mid-mount type, a top-mount type, or a vertical type according to a form in which the connector is mounted on the PCB 141. Although the embodiments based on the top-mount type are mainly described in the present disclosure, the same titles or functions may be applied to the mid-mount type or the vertical type.

The plug 190 corresponding to the connector 100 may be coupled to the connector 100. The outside of the connector 100 may be covered by the shell 107 of a metallic material.

The shell 107 may be fixed to the ground (GND) of the shell 191 of the PCB 141 while protecting the interior of the connector. For example, the shell 107 may be electrically connected to a ground terminal 131 of the PCB 141. Here, the electrical connection indicates that a current may flow through two or more conductive materials that are in physical contact.

As the shell 107 is connected to the ground terminal 131, the shell 107 may interrupt external noise (for example, electromagnetic waves introduced from the outside) and also may perform an electromagnetic wave shielding function. Furthermore, the shell 107 also may interrupt electromagnetic waves irradiated from the interior of the connector 100.

The plug 190 may have a shape corresponding to the connector 100 to be coupled to the connector 100. When the plug 190 is coupled to the connector 100, the plug 190 and the connector 100 may be electrically connected to each other.

The mid-plate 101 may be formed of a conductive material (for example, a metal) and may be situated in the interior of the insulation member 103. A part of the mid-plate 101 may be exposed to the outside of the insulation member 103 through a side surface of the insulation member 103 to make contact with the shell 191 of the plug 190 when the plug 190 is coupled. The mid-plate 101 may be inserted into the interior of the insulation member 103 through an insert (or injection) molding method. The mid-plate 101 may be a metal plate.

The plurality of terminals 105 may be situated on and under the insulation member 103. For example, twelve terminals may be situated on the insulation member 103 and twelve terminals may be situated under the insulation member 103. Furthermore, some terminals that do not perform any function or perform an unnecessary function in the electronic device 401 may be eliminated. Hereinafter, the terminals on the insulation member 103 may be referred to as upper terminals, and the terminals under the insulation member 103 may be referred to as lower terminals. The arrangement sequences of the upper terminals and the lower terminals may be point-symmetrical to each other with respect to the center of the mid-plate 101. In other words, the lower terminals may be arranged in the reverse sequence of the arrangement sequence of the upper terminals. The functions of the terminals will be described below.

A part of the mid-plate 101 may be electrically connected to the ground terminal 131 of the PCB 141 while making direct contact with the ground terminal 131 of the PCB 141. The mid-plate 101 may be situated between the upper terminals and the lower terminals. The insulation member 103 is situated between the upper terminals and the mid-plate 101 such that the upper terminals and the mid-plate 101 are electrically separated from each other. The insulation member 103 is situated between the lower terminals and the mid-plate 101 such that the lower terminals and the mid-plate 101 are electrically separated from each other.

The insulation member 103 is a nonconductive material, and may physically separate the upper terminals and the lower terminals. Further, the insulation member 103 may physically separate the upper terminals and the mid-plate 101. Furthermore, the insulation member 103 may physically separate the lower terminals and the mid-plate 101. In addition, the insulation member 103 may support the plurality of terminals 105 and the mid-plate 101. The insulation member 103 may constantly maintain the intervals between the terminals (for example, the spacing distance between the upper terminals and the lower terminals). Further, the insulation member 103 may constantly maintain the interval between the upper terminals and the mid-plate 101. Furthermore, the insulation member 103 may constantly maintain the interval between the lower terminals and the mid-plate 101.

The PCB 141 illustrated in FIG. 4 may be understood as corresponding to a part of the PCB included in the electronic device. For example, the PCB may have various sizes and shapes, and components other than the components illustrated in FIG. 4 may be additionally mounted on the entire PCB.

Figure 5:
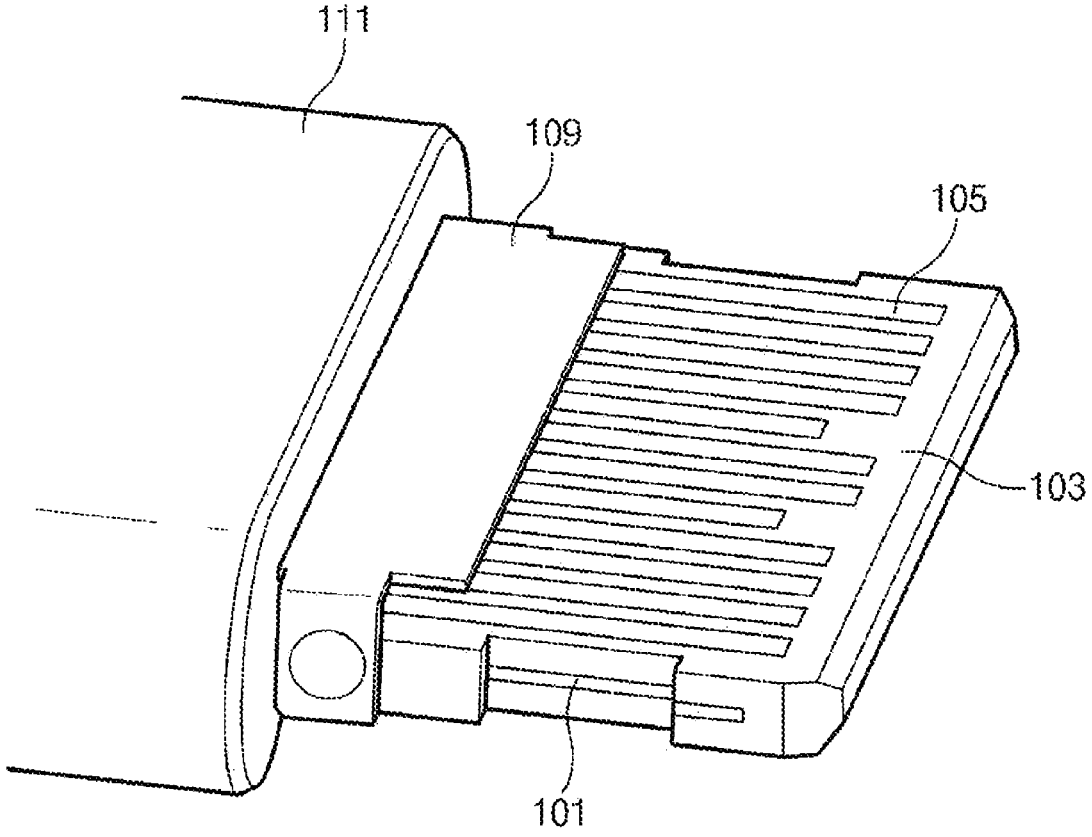
FIG. 5 illustrates an interior structure of a connector according to an embodiment of the present disclosure.

FIG. 5 illustrates an interior structure of a connector according to an embodiment of the present disclosure.

Referring to FIG. 5, a mid-plate 101, a plurality of terminals 105, an insulation member 103, an electromagnetic compatibility (EMC) pad 109, and a body 111 are illustrated.

The mid plate 101 is situated in the interior of the insulation member 103, and a part of the middle plate 101 is exposed to the outside of the insulation member 103 to make contact with a corresponding part of the plug 190 when the plug 190 (see FIG. 4) is coupled. A plurality of terminals 105 may be disposed on the insulation member 103 at a specific interval. The plurality of terminals 105 may make contact with, for example, a plurality of terminals 122 (see FIG. 12) in the plug 190 when the plug 190 is inserted.

The mid-plate 101 may be inserted into the interior of the insulation member 103 through an insert molding method. A part of the mid-plate 101 may be connected to the ground terminal 131 of the PCB through soldering, and the like. The EMC pad 109 may be situated on the plurality of terminals 105.

The EMC pad 109 may be a conductive pad (for example, a metal pad), and may shield electromagnetic waves irradiated from the plurality of terminals 105 or electromagnetic waves introduced from the outside. The irradiated electromagnetic waves may influence the communication performance of the electronic device 1201. The introduced electromagnetic wave may influence an electrical signal that passes through the connector. The introduced electromagnetic waves may be a communication signal of the electronic device 1201. The introduced electromagnetic wave may be generated by an operation of a component included in the electronic device 1201.

In the following description, the EMC pad 109 may be referred to as a metal pad. The EMC pad 109 may be implemented to cover at least a part of the insulation member 103. The EMC pad 109 may include a pair of pads consisting of, for example, an upper end pad 109*a* (see FIG. 6) and a lower end pad 109*b* (see FIG. 6). The upper end pad and the lower end pad may be fitted with each other. For example, convexo-concave portions are formed at points where the upper end pad and the lower end pad make contact with each other so that the upper end pad and the lower end pad are easily fitted with each other. The EMC pad 109 may be integrally formed.

The EMC pad 109 and the mid-plate 101 may be electrically connected to each other. The EMC pad 109 may be joined to the mid-plate 101 through welding or may make contact with the mid-plate 101 by using resiliency. The welding is used to join metals and may include soldering. A contact structure of the EMC pad 109 and the mid-plate 101 will be described below. As the EMC pad 109 and the mid-plate 101 are electrically connected to each other, the potential of the EMC pad 109 may be maintained at the ground level. When the plug 190 is inserted, the EMC pad 109 may be electrically connected to ground (GND) springs 120 (see FIG. 12) of the plug 190 while making contact with the ground springs 120 of the plug 190.

An insulation material extending from the body 111 may be filled between the EMC pad 109 and the plurality of terminals 105. In order to reduce the length of the connector, the EMC pad 109 may not make physical contact with the shell 107 (see FIG. 4). For example, the shell 107 (see FIG. 4) and the EMC pad 109 do not directly contact each other, and may be physically separated from each other. Because the shell 107 (see FIG. 4) and the EMC pad 109 do not make direct contact with each other, a connection part of the EMC pad 109 and the shell 107 (see FIG. 4) is not necessary and accordingly, the length of the connector may be reduced.

The insulation member 103 is a nonconductive material, and may separate the plurality of terminals 105 at a specific interval and support them. In addition, the insulation member 103 may electrically separate the plurality of terminals 105 and the mid-plate 101 and support them. The insulation member 103 may include one component, but also may include a plurality of components (for example, the upper end insulation member and the lower end insulation member).

The body 111 may support the upper end insulation member and the lower end insulation member. A part of the body 111 may extend into the interior of the EMC pad 109, and may separate the plurality of terminals 105 and the EMC pad 109 at a specific interval.

The shell 107 (see FIG. 4) may be disposed to surround the body 111 while being spaced apart from the body 111.

Figure 6:
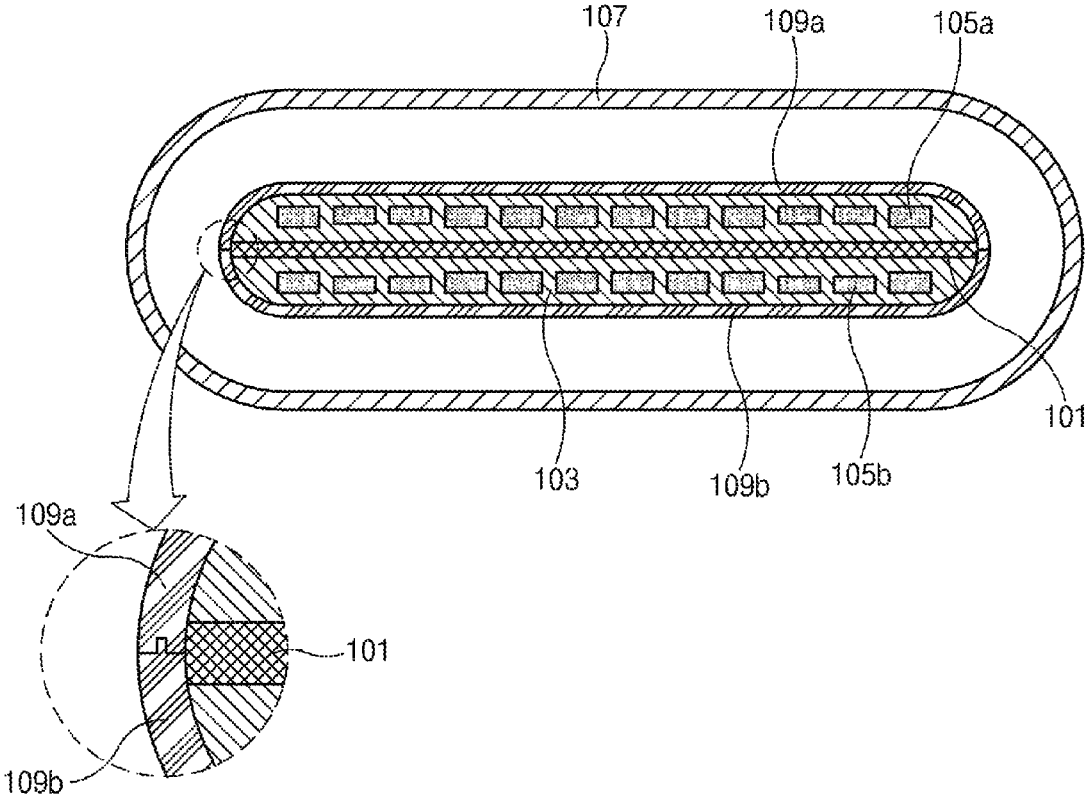
FIG. 6 illustrates a front view of a connector according to an embodiment of the present disclosure.

FIG. 6 illustrates a front view of a connector according to various embodiments of the present disclosure. For example, FIG. 6 illustrates a view of the connector when viewed in a direction 192 of FIG. 4.

Referring to FIG. 6, the outside of the connector is surrounded by the shell 107. An EMC pad 109*a* and 109*b*, a mid-plate 101, a plurality of terminals 105*a* and 105*b*, and an insulation member 103 may be provided in the interior of the connector. The electro-motive division (EMD) pads 109*a* and 109*b* may be formed of a metallic material, and may be electrically connected to the mid-plate 101 to shield electromagnetic waves. The EMC pads 109*a* and 109*b* may include an upper pad 109*a* and a lower pad 109*b*. A convexo-concave portion may be formed at a connection part of the upper pad 109*a* and the lower pad 109*b* as illustrated in the enlarged view such that the upper pad 109*a* and the lower pad 109*b* are fitted with each other. Furthermore, the EMC pad may include one body while the upper and lower sides are not divided.

The EMC pads 109*a* and 109*b* and the mid-plate 101 may make physical contact with each other, and may be electrically connected to each other. The EMC pads 109*a* and 109*b* may be joined to the mid-plate 101 through welding. Furthermore, the EMC pads 109*a* and 109*b* may make physical contact with the mid-plate 101 through an elastic body integrally formed with the mid-plate 101. Furthermore, the EMC pads 109*a* and 109*b* and the mid-plate 101 may be in contact with each other without using a separate welding process or elastic body.

A part of the mid-plate 101 may be fixed through soldering while making contact with the ground terminal 131 of the PCB 141. The mid-plate 101 may be electronically connected to the ground terminal 131 of the PCB 141 and may comprise metallic material.

The mid-plate 101 may be a metal plate. Parts of the left and right side surfaces of the mid-plate 101 may be cut way such that elastic bodies having a wing shape are integrally formed with the mid-plate 101, to maintain a contact state of the mid-plate 101 and the EMC pad 109 when the mid-plate 101 makes contact with the EMC pad 109. The elastic bodies of the mid-plate 101 may make contact with the EMC pads 109*a* and 109*b* to firmly maintain the contact state by using resiliency. In various embodiments of the present disclosure, the mid-plate 101 may make contact with the EMC pads 109*a* and 109*b* without using an elastic body. The mid-plate 101 may be inserted into the interior of the insulator through an insert molding method. The shape of the mid-plate 101 will be described with reference to FIGS. 9A and 9B.

The plurality of terminals 105 may include a plurality of upper terminals 105*a* and a plurality of lower terminals 105*b*. The plurality of upper terminals 105*a* may be situated between the EMC pads 109*a* and 109*b* and the mid-plate 101. For example, the plurality of upper terminals 105*a* may be situated on the mid-plate 101. The plurality of lower terminals 105*b* may be situated under the mid-plate 101. For example, the number of the plurality of upper terminals 105*a* may be twelve, and may be situated between the EMC pad 109*a* and the mid-plate 101. The plurality of lower terminals 105*b* may be twelve, and may be situated between the EMC pad 109*b* and the mid-plate 101. The plurality of upper terminals 105*a* and the plurality of lower terminals 105*b* may include a power line, a ground line, and data lines. The arrangement sequences of the plurality of upper terminals 105*a* may be point-symmetrical to the arrangement sequences of the plurality of lower terminals 105*b*.

The insulation member 103 may include an upper end part and a lower end part, and the upper end insulation member may be situated on the mid-plate 101 and may support the upper terminals 105*a*. The lower end insulation member may be situated under the mid-plate 101 and may support the lower terminals 105*b*. For example, the mid-plate 101 may be situated between the upper end insulation member and the lower end insulation member.

The upper end part and the lower end part of the insulation member may be separate independent members, and a convexo-concave portion may be formed in the insulation member such that the upper end part and the lower end part are fitted with each other when the insulation member is assembled.

The shell 107 may be disposed outside the connector, and may protect internal components of the connector and may interrupt introduction and radiation of electromagnetic waves.

Figure 7:
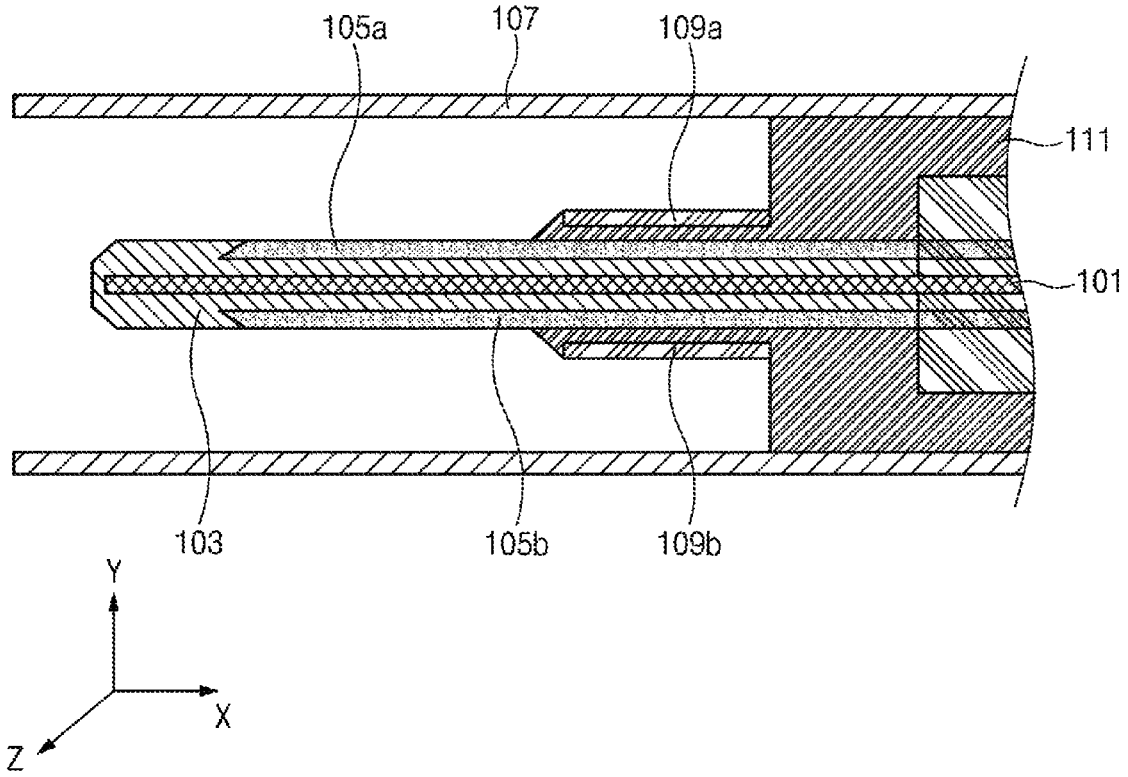
FIG. 7 illustrates a sectional view of a connector when viewed in direction A-B of FIG. 4 according to an embodiment of the present disclosure.

FIG. 7 illustrates a sectional view of a connector when viewed in direction A-B of FIG. 4 according to an embodiment of the present disclosure.

Referring to FIG. 7, in a sectional view of the connector when viewed in direction A-B 193, the shell 107, the body 111, the EMC pads 109*a* and 109*b*, the plurality of terminals 105*a* and 105*b*, the insulation member 103, and the mid-plate 101 are illustrated.

The shell 107 is formed of a metallic material and protects the interior of the connector. The shell 107 is soldered and fixed to the ground terminal 131 of the PCB 141 and maintains a ground potential.

The body 111 may make contact with the shell 107 and may fix the insulation member 103. The body 111 may be a nonconductive member, and may be an insulator. A part of the body 111 may make contact with the EMC pad 109*a* and 109*b*. A part of the body 111 may make contact with the terminals 105*a* and 105*b*. The body 111 may function as an insulation between the EMC pads 109*a* and 109*b* and the terminals 105*a* and 105*b*. Furthermore, the body 111 may maintain a specific/certain distance between the EMC pads 109*a* and 109*b* and the terminals 105*a* and 105*b*.

The EMD pads 109*a* and 109*b* may be fixed to the insulation member 103 while forming a band shape. The EMD pads 109*a* and 109*b* may be formed of a metallic material, and may surround the insulation member 103. The EMC pads 109*a* and 109*b* may include an upper end pad 109*a* and a lower end pad 109*b*. The EMC pads 109*a* and 109*b* may be integrally formed. The EMC pads 109*a* and 109*b* may be spaced apart from the insulation member 103 by a specific distance.

The EMC pads 109*a* and 109*b* include a surface that is parallel to the plurality of terminals 105*a* and 105*b*, but does not include a surface that is perpendicular to the plurality of terminals 105*a* and 105*b* except for the thickness component. For example, the EMC pads 109*a* and 109*b* have surfaces corresponding to the XZ plane and the XY plane, but do not have a surface corresponding to the ZY plane, except for the thickness component. For example, the EMC pads 109*a* and 109*b* may be a metal band.

Because the EMC pads 109*a* and 109*b* do not have a surface included in the ZY plane, the length of the connector may be reduced. The EMC pads 109*a* and 109*b* should maintain the ground potential to shield electromagnetic waves, and may make contact with ground (GND) springs 120*a* and 120*b* (see FIG. 12) of the plug 190 when the plug 190 is inserted.

The plurality of terminals 105*a* and 105*b* may include upper terminals 105*a* and lower terminals 105*b*. The plurality of terminals 105*a* and 105*b* may be formed of a conductive material (for example, metal lines). The plurality of terminals 105*a* and 105*b* may be supported by the insulation member 103 and may be spaced apart from each other by a specific interval. The plurality of terminals 105*a* and the EMC pad 109*a* may be spaced apart from each other by a specific distance. Similarly, the plurality of terminals 105*b* and the EMC pad 109*b* may be spaced apart from each other by a specific distance.

The insulation member 103 may fix and support the plurality of terminals 105*a* and 105*b*. The insulation member 103 may space the plurality of terminals 105*a* and the plurality of terminals 105*b* apart from each other by a specific distance. The insulation member 103 may space the plurality of terminals 105*a* and the mid-plate 101 apart from each other by a specific distance. The insulation member 103 may space the plurality of terminals 105*b* and the mid-plate 101 apart from each other by a specific distance.

The mid-plate 101 may be disposed at a central portion of the section. A part of the mid-plate 101 may be fixed through soldering while making contact with the ground terminal 131 of the PCB 141. The mid-plate 101 may be a metal plate. The mid-plate 101 may be electrically connected to at least one of the EMD pad 109*a* and the EMC pad 109*b*. Because a part of the mid-plate 101 is connected to the ground terminal 131 of the PCB 141, the EMC pads 109*a* and 109*b* also may maintain a ground potential.

The mid-plate 101 and the EMC pads 109*a* and 109*b* may be joined through welding. The mid-plate 101 and the EMC pads 109*a* and 109*b* may make contact with each other without using welding. Parts of the left and right side surfaces of the mid-plate 101 may be cut way such that elastic bodies having a wing shape are integrally formed with the mid-plate 101, to maintain a contact state of the mid-plate 101 and the EMC pads 109*a* and 109*b* when the mid-plate 101 makes contact with the EMC pads 109*a* and 109*b*. The elastic bodies of the mid-plate 101 may elastically make contact with the EMC pads 109*a* and 109*b* to firmly maintain the contact state. The mid-plate 101 may make contact with the EMC pads 109*a* and 109*b* without using an elastic body. The mid-plate 101 may be inserted into the interior of the insulation body through an insert molding method.

Figure 8:
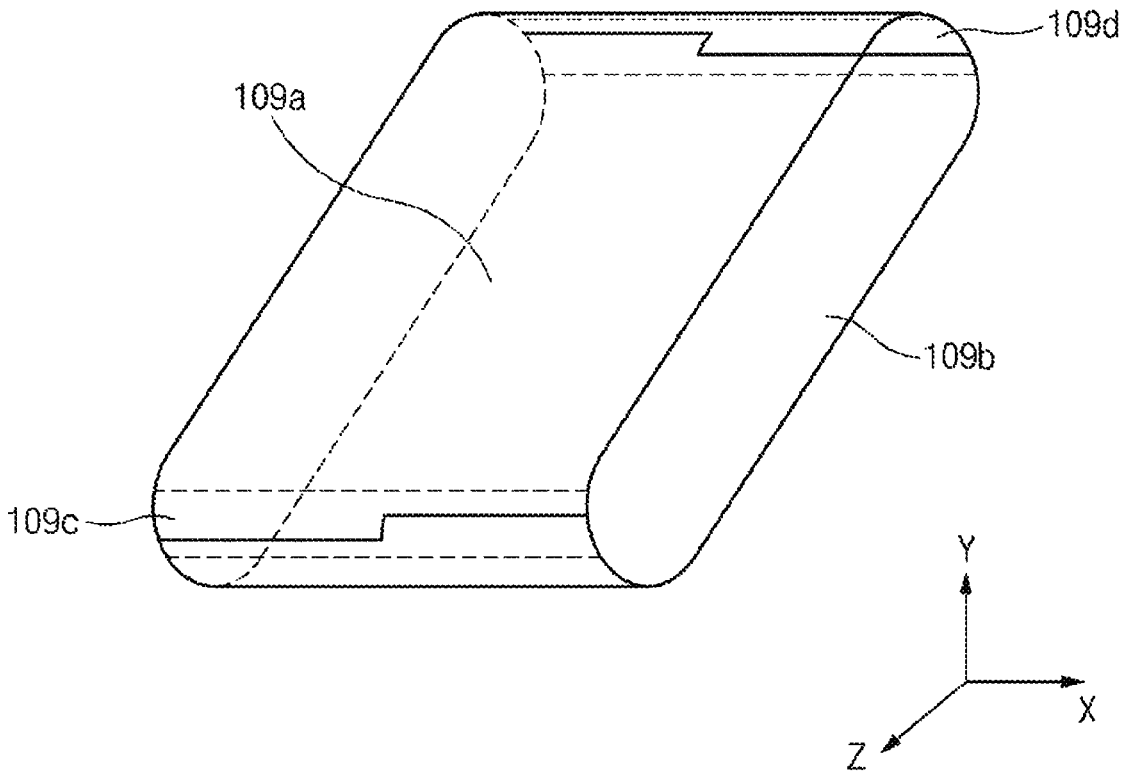
FIG. 8 illustrates an electromagnetic compatibility (EMC) pad according to an embodiment of the present disclosure.

FIG. 8 illustrates an EMC pad according to an embodiment of the present disclosure.

Referring to FIG. 8, the EMC pads 109*a* and 109*b* and joined parts 109*c* and 109*d* are illustrated. The EMC pads 109*a* and 109*b* may be formed of a metallic material. The EMC pads 109*a* and 109*b* may be formed of a conductive material.

The EMC pads 109*a* and 109*b* may include an upper pad 109*a* and a lower pad 109*b*. The EMC pads 109*a* and 109*b* have a band shape, and have a surface included in the XZ plane and a surface included in the XY plane but does not have a surface included in the ZY plane except for the thickness component. A contact part of the upper pad 109*a* and the lower pad 109*b* may have a convexo-concave shape. A contact part of the upper pad 109*a* and the lower pad 109*b* may have a flat shape without a convexo-concave portion. The contact parts 109*c* and the 109*d* of the upper pad 109*a* and the lower pad 109*b* may be joined to the mid-plate through welding or without using welding. Because the EMC pads 109*a* and 109*b* are joined to the mid-plate 101, the EMC pads 109*a* and 109*b* may maintain a ground potential. For example, the EMC pads 109*a* and 109*b* may make electrical contact with the mid-plate 101 having a ground potential and also may maintain a ground potential.

The EMC pads 109*a* and 109*b* may be integrally formed.

When the plug 190 is inserted into the connector, the EMC pads 109*a* and 109*b* may make contact with the ground (GND) springs 120*a* and 120*b* of the plug 190.

Figure 9A:
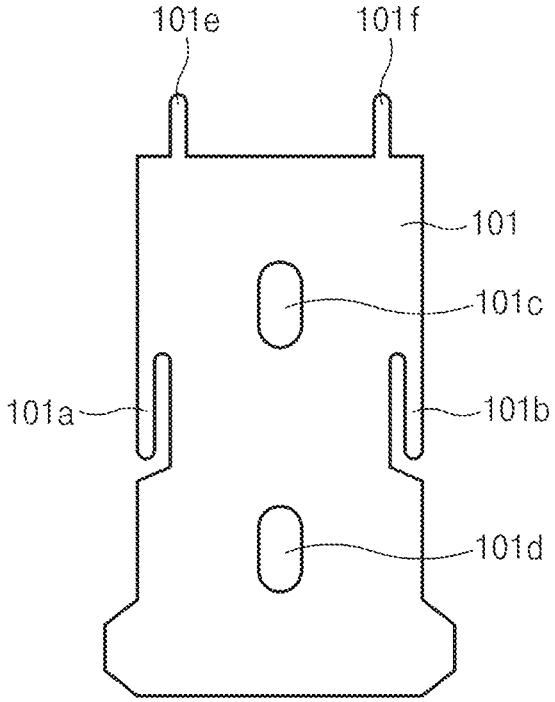
FIGS. 9A and 9B illustrate a mid-plate according to an embodiment of the present disclosure.
Figure 9B:
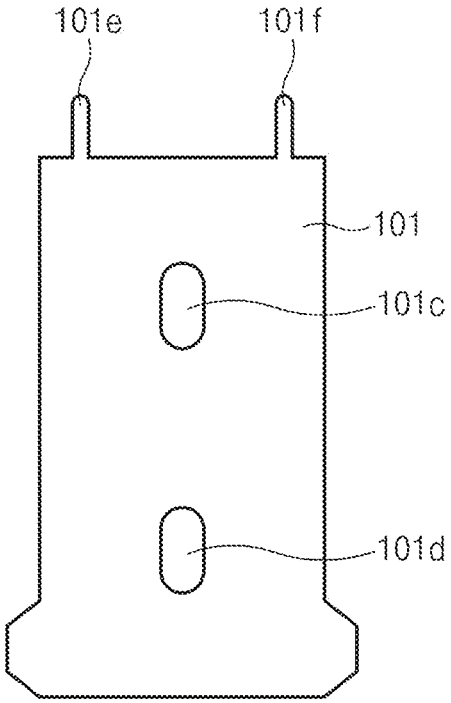

FIGS. 9A and 9B illustrate a mid-plate according to an embodiment of the present disclosure.

Referring to FIG. 9A, parts of the left and right side surfaces of the mid-plate 101 are cut away to form elastic bodies 101*a* and 101*b* having a wing shape. The elastic bodies 101*a* and 101*b* having a wing shape may make contact with the EMD pads 109*a* and 109*b* (see FIG. 6). The elastic body 101*a* of the mid-plate 101 may make contact with a joined part 109*c* (see FIG. 8) of the EMD pad, and the elastic body 101*b* of the mid-plate 101 may make contact with the EMC pad at a joined part 109*c* (see FIG. 8) of the EMC pad.

Parts 101*e* and 101*f* of the mid-plate 101 may be connected to the ground terminal 131 while having a ground potential. The EMD pads 109*a* and 109*b* (see FIG. 6) that makes contact with the mid-plate also may have a ground potential.

The mid-plate 101 may have holes 101*c* and 101*d*. A protrusion 141*a* (see FIG. 10) extending from the insulation member 103 (see FIG. 7) may pass through the holes 101*c* and 101*d*. In an embodiment of the present disclosure, the mid-plate 101 may not have a hole.

FIG. 9B illustrates a mid-plate that does not have elastic bodies on left and right side surfaces as in FIG. 9A.

Referring to FIG. 9B, the left and right side surfaces of the mid-plate 101 may be electrically connected to the EMD pad while making contact with the EMD pad.

Figure 10:
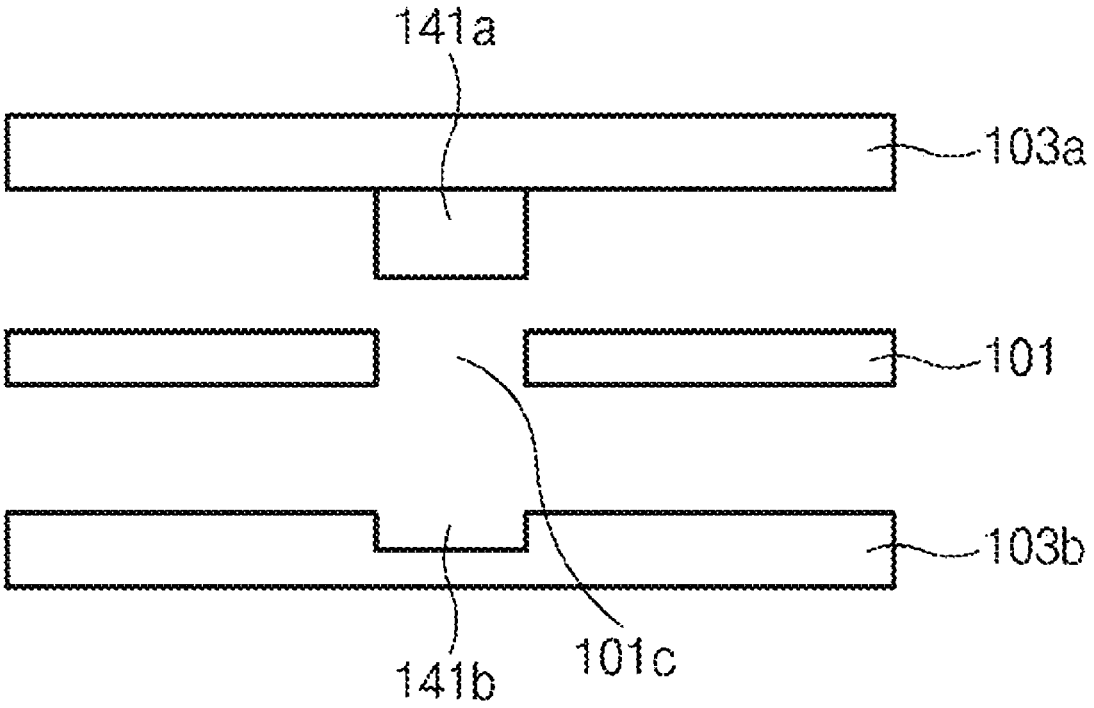
FIG. 10 illustrates a section where upper and lower end insulation members and a mid-plate are coupled to each other according to an embodiment of the present disclosure.

FIG. 10 illustrates a section where upper and lower end insulation members and a mid-plate are coupled to each other according to an embodiment of the present disclosure.

Referring to FIG. 10, an upper end insulation member 103*a*, the middle plate 101, and a lower end insulation member 103*b* are illustrated. The upper end insulation member 103*a* may include at least one protrusion 141*a*.

As described with reference to FIG. 9A, the mid-plate 101 may include at least one hole. The lower end insulation member 103*b* may include at least one groove. In an embodiment of the present disclosure, the protrusion included in the upper end insulation member 103*a* may pass through the hole 103*c* formed in the mid-plate 101 and may be fitted with a recess 141*b* included in the lower end insulation member 103*b*. The inverse case is also possible. The upper end insulation member 103*a* may have a recess and the lower end insulation member 103*b* may have a protrusion.

Figure 11:
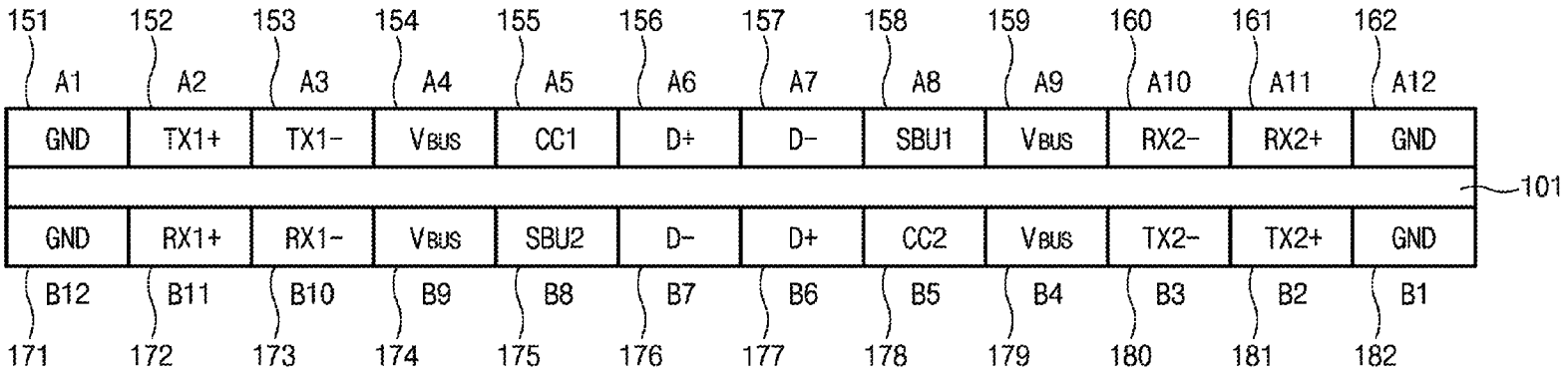
FIG. 11 illustrates arrangement sequences of a plurality of terminals according to an embodiment of the present disclosure.

FIG. 11 illustrates arrangement sequences of a plurality of terminals according to an embodiment of the present disclosure.

Referring to FIG. 11, upper terminals 151 to 162, lower terminals 171 to 182, and a mid-plate 101 are illustrated. The upper terminals 151 to 162 may include terminals having the arrangement sequences of GND, TX1+, TX1−, VBUS, CC1, D+, D−, SBU1, VBUS, RX2−, RX2+, and GND from the left side of FIG. 11. The lower terminals 171 to 182 may include terminals having the arrangement sequences of GND, TX2+, TX2−, VBUS, CC2, D+, D−, SBU2, VBUS, RX1−, RX1+, and GND from the right side of FIG. 11. The arrangement sequences of the lower terminals 171 to 182 may be point-symmetrical to the arrangement sequences of the upper terminals 151 to 162. For example, the upper terminals 151, 152, 153, . . . , and 162 may match with the lower terminals 182, 181, 180, . . . , and 171. Because the arrangement sequences of the upper terminals 151 to 162 are point-symmetrical to the arrangement sequences of the lower terminals 171 to 182, signals that flow through the terminals may be the same even if the plug 190 (see FIG. 1) is connected to the connector after being turned by 180 degrees.

Figure 12:
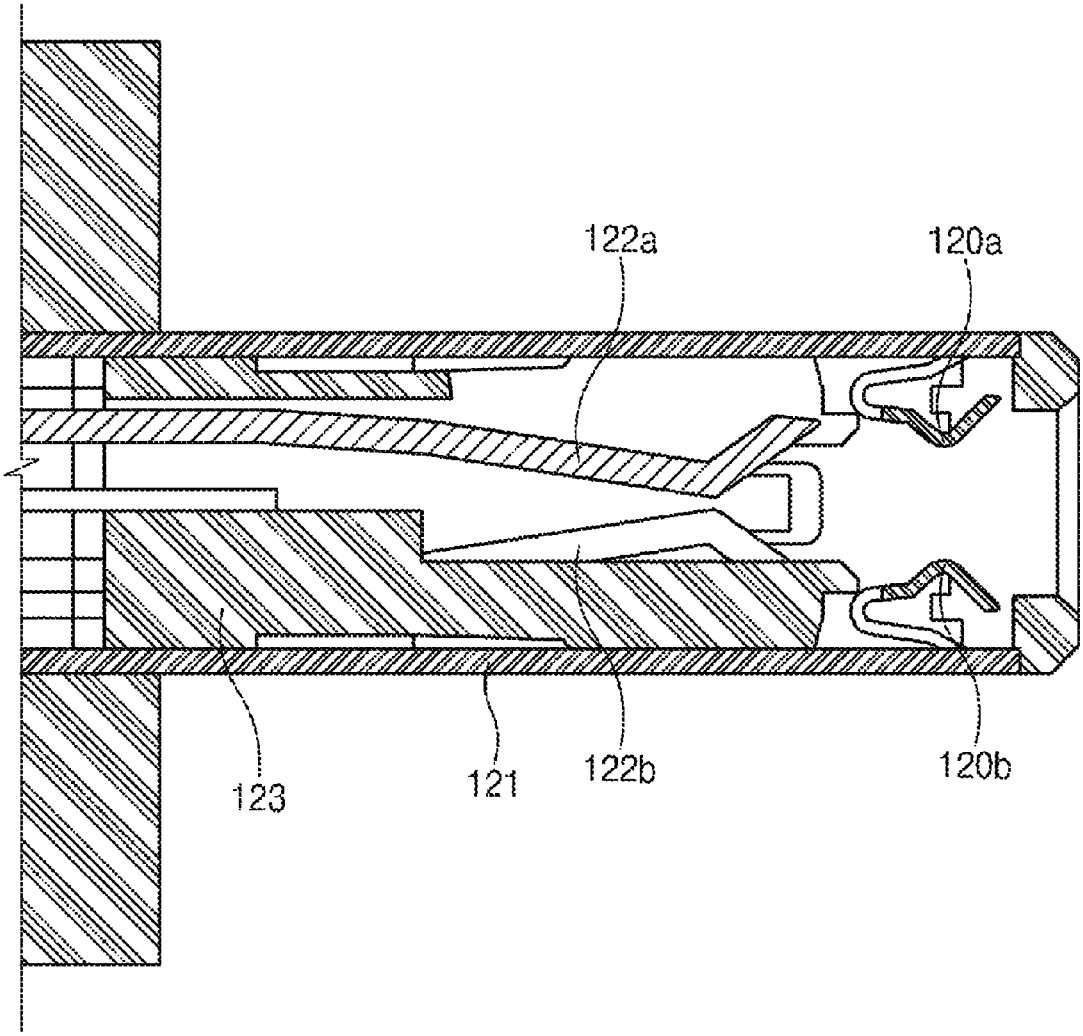
FIG. 12 illustrates a sectional view of a connector when viewed in direction C-D of FIG. 4 according to an embodiment of the present disclosure.

FIG. 12 illustrates a sectional view of a connector when viewed in direction C-D of FIG. 4 according to an embodiment of the present disclosure. For example, FIG. 12 illustrates a section obtained by cutting the plug of FIG. 4 illustrates with reference to a direction C-D 194.

Referring to FIG. 12, a shell 121 of a plug, ground springs 120*a* and 120*b*, a plurality of terminals 122*a* and 122*b* of the plug, and an insulation member are illustrated.

The shell 121 is formed of a metallic material and protects the interior of the plug. The ground (GND) springs 120*a* and 120*b* may be formed of a metallic material, and may make contact with the EMD pads 109*a* and 109*b* when the plug is inserted into the connector.

The mid-plate 101 (see FIG. 4) is a metal plate, and parts 101*e* and 101*f* of the mid-plate 101 may be connected to the ground terminal 131 while having a ground potential. The EMD pads 109*a* and 109*b* (see FIG. 6) that make contact with the mid-plate 101 also may have a ground potential, and the ground (GND) springs 120*a* and 120*b* of the plug that make contact with the EMC pads 109*a* and 109*b* (see FIG. 5) also may have the same ground potential.

An insulation member 123 may make contact with the plurality of terminals 122*a* and 122*b*. The insulation member 123 functions as an insulator between the plurality of terminals 122*a* and 122*b* of the plug and the shell 121.

When the plug 190 is inserted into the connector, the plurality of terminals 122*a* and 122*b* may make contact with the plurality of terminals 105*a* and 105*b* of the connector.

According to various embodiments of the present disclosure, in the connector, because the EMC pad in the interior of the connector for shielding electromagnetic waves and the mid-plate inserted into the insulation member are electrically connected to each other and also are connected to the ground, the size of the connector can be reduced by reducing the size of the EMC pad for shielding electromagnetic waves.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A connector mounted on a printed circuit board (PCB), the connector comprising:

a mid-plate electrically connected to a ground terminal of the PCB and comprising a metallic material;

a plurality of upper terminals situated on the mid-plate;

a plurality of lower terminals situated under the mid-plate;

a first insulation member situated above the mid-plate while supporting the plurality of upper terminals;

a second insulation member situated under the mid-plate while supporting the plurality of lower terminals;

a pad electrically connected to the mid-plate and shielding an electromagnetic wave; and a metallic shell electrically connected to the ground terminal of the PCB, wherein the metallic shell and the pad are spaced apart from each other by a certain distance.

2. The connector of claim 1, wherein the mid-plate and the pad are joined to each other through welding.

3. The connector of claim 1, wherein the mid-plate is disposed between the first insulation member and the second insulation member.

4. The connector of claim 1, wherein the mid-plate is coupled to the first insulation member and the second insulation member through injection molding.

5. The connector of claim 1, wherein the mid-plate comprises at least one hole.

6. The connector of claim 5, wherein at least one of the first insulation member and the second insulation member comprises a boss that passes through the hole.

7. The connector of claim 6, wherein at least one of the first insulation member and the second insulation member comprises a recess that is fitted with the boss.

8. The connector of claim 1, wherein the mid-plate comprises an elastic body that makes elastic contact with the pad.

9. The connector of claim 1, further comprising:

a body that supports the first insulation member and the second insulation member.

10. The connector of claim 9, wherein the metallic shell surrounds the body.

11. The connector of claim 9, wherein a part of the body is disposed between the plurality of upper terminals and the pad.

12. The connector of claim 1, wherein the pad comprises a surface that is parallel to the terminals and does not comprise a surface that is perpendicular to the terminals.

13. The connector of claim 1, wherein the plurality of upper terminals is arranged such that the arrangement sequences of the plurality of upper terminals are point-symmetrical to the arrangement sequences of the plurality of lower terminals.

14. The connector of claim 1, wherein the pad comprises a pair of pads consisting of an upper end pad and a lower end pad, and wherein the upper end pad and the lower end pad are fitted with each other.

15. A connector mounted on a printed circuit board (PCB), the connector comprising:

a mid-plate electrically connected to a ground terminal of the PCB and comprising a metallic material;

a plurality of upper terminals situated on the mid-plate;

a plurality of lower terminals situated under the mid-plate;

a first insulation member situated above the mid-plate while supporting the plurality of upper terminals;

a second insulation member situated under the mid-plate while supporting the plurality of lower terminals; and a pad electrically connected to the mid-plate and shielding an electromagnetic wave, wherein the pad comprises a pair of pads consisting of an upper end pad and a lower end pad, and wherein the upper end pad and the lower end pad are fitted with each other.

* * * * *